US008978925B2

(12) United States Patent
Babikian

(10) Patent No.: US 8,978,925 B2
(45) Date of Patent: Mar. 17, 2015

(54) PAPER TOWEL CABINET WITH PAPER TOWEL MODULE

(75) Inventor: Dikran Babikian, Glendale, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 703 days.

(21) Appl. No.: 12/618,653

(22) Filed: Nov. 13, 2009

(65) Prior Publication Data

US 2011/0114661 A1 May 19, 2011

(51) Int. Cl.
*A47K 10/24* (2006.01)
*B65H 1/00* (2006.01)

(52) U.S. Cl.
USPC ..... 221/45; 221/34; 221/48; 221/44; 221/54; 221/62; 221/52; 221/102; 221/155; 221/56; 221/63; 221/197

(58) Field of Classification Search
CPC ..... A47K 2010/3266; A47K 2010/428; A47K 10/421; A47K 10/42; A47K 10/3818; A47K 10/424
USPC ..... 221/45, 34, 102, 44, 54, 48, 62, 52, 221/155, 56, 63, 197
See application file for complete search history.

(56) References Cited

U.S. PATENT DOCUMENTS

| | | | | |
|---|---|---|---|---|
| 1,101,004 | A | | 6/1914 | Aicher et al. |
| 1,101,378 | A | | 6/1914 | Aicher et al. |
| 1,110,523 | A | | 9/1914 | Aicher et al. |
| 1,179,020 | A | | 4/1916 | Marcuse |
| 1,254,509 | A | | 1/1918 | Kistemann |
| 1,258,003 | A | | 3/1918 | Hawley |
| 1,319,281 | A | | 10/1919 | Hoberg |
| 1,438,320 | A | | 12/1922 | Marcuse |
| 1,503,241 | A | | 7/1924 | Horwitt |
| 1,509,048 | A | | 9/1924 | Marcuse |
| 1,610,670 | A | | 12/1926 | Funk |
| 1,783,149 | A | * | 11/1930 | Jantzen ..... 221/34 |
| 2,085,480 | A | | 6/1937 | Shaffer |
| 2,426,787 | A | * | 9/1947 | O'Neil ..... 221/45 |
| 3,269,592 | A | | 8/1966 | Slye et al. |
| 3,713,561 | A | | 1/1973 | Wyant |
| 3,935,965 | A | | 2/1976 | Stevens |

(Continued)

OTHER PUBLICATIONS

Written Opinion of the International Searching Authority for International Application No. PCT/US2006/049676, filed Dec. 29, 2006, Written Opinion dated Jun. 3, 2008 and mailed Jul. 7, 2008 (3 pgs.).

(Continued)

*Primary Examiner* — Rakesh Kumar
(74) *Attorney, Agent, or Firm* — Christie, Parker & Hale, LLP

(57) ABSTRACT

A paper towel cabinet includes a first side wall and a second side wall, a pivotally mounted front wall defining a door, a back wall extending between the side walls, and a paper towel tray having an opening to provide access to paper towels. The paper towel cabinet also includes a module assembly comprising a first module having a front surface extending transversely relative to the first side wall and toward the second side wall. When the door is in an open position, the front surface prevents paper towels leaning toward the door from falling out of the cabinet. The cabinet also includes a bar mounted proximate to the opening and having a length extending between the side walls. The bar is positioned between a stack of paper towels and the opening when the stack of paper towels is placed on the paper towel tray.

15 Claims, 8 Drawing Sheets

(56) References Cited

U.S. PATENT DOCUMENTS

| | | | | | |
|---|---|---|---|---|---|
| 3,960,291 | A | | 6/1976 | Navi | |
| 4,113,157 | A | * | 9/1978 | Woodbury | 224/163 |
| 4,679,703 | A | | 7/1987 | De Luca | |
| 4,877,154 | A | | 10/1989 | Matsui | |
| 5,018,614 | A | * | 5/1991 | Ruckert | 194/236 |
| 5,065,895 | A | | 11/1991 | De Luca et al. | |
| 5,074,430 | A | * | 12/1991 | Roberts | 221/44 |
| 5,090,592 | A | | 2/1992 | Petterson et al. | |
| 5,100,020 | A | | 3/1992 | Petterson et al. | |
| 5,102,007 | A | | 4/1992 | Petterson et al. | |
| 5,219,092 | A | | 6/1993 | Morand | |
| 5,335,822 | A | * | 8/1994 | Kasper | 221/259 |
| 5,590,813 | A | * | 1/1997 | Abramczyk | 221/197 |
| 5,857,588 | A | * | 1/1999 | Kasper | 221/274 |
| 5,941,414 | A | * | 8/1999 | Kasper | 221/210 |
| 5,950,863 | A | | 9/1999 | Schutz et al. | |
| 6,003,723 | A | | 12/1999 | Morand | |
| 6,053,355 | A | * | 4/2000 | Rupp et al. | 221/45 |
| 6,241,118 | B1 | | 6/2001 | Tramontina | |
| 6,315,155 | B1 | | 11/2001 | Hubanks et al. | |
| 6,378,726 | B1 | | 4/2002 | Chan et al. | |
| 6,412,679 | B2 | | 7/2002 | Formon et al. | |
| 6,422,416 | B1 | | 7/2002 | Tramontina | |
| 6,520,372 | B2 | | 2/2003 | Phelps | |
| 6,543,641 | B2 | | 4/2003 | Hubanks et al. | |
| 6,553,879 | B2 | | 4/2003 | Morand | |
| 6,592,002 | B2 | | 7/2003 | Clark et al. | |
| 6,607,093 | B1 | * | 8/2003 | Morad et al. | 221/33 |
| 6,779,683 | B2 | | 8/2004 | Taylor et al. | |
| 6,899,251 | B2 | | 5/2005 | Christensen et al. | |
| 7,121,426 | B2 | * | 10/2006 | Runnels | 221/2 |
| 7,128,238 | B2 | * | 10/2006 | Runnels | 221/198 |
| 7,845,515 | B2 | * | 12/2010 | Moody | 221/36 |
| 8,152,021 | B2 | * | 4/2012 | Babikian | 221/45 |
| 2002/0070228 | A1 | | 6/2002 | Moody | |
| 2002/0074340 | A1 | * | 6/2002 | Phelps | 221/45 |
| 2003/0057221 | A1 | | 3/2003 | Guillemette et al. | |
| 2007/0151980 | A1 | | 7/2007 | Babikian et al. | |

OTHER PUBLICATIONS

International Search Report for International Application No. PCT/US2006/049676, filed Dec. 29, 2006, International Search Report dated Jun. 3, 2008 and mailed Jul. 7, 2008 (2 pgs.).

* cited by examiner

PAPER TOWEL CABINET WITH PAPER TOWEL MODULE

The present application generally relates to paper towel dispensers, and more particularly, to a paper towel cabinet with paper towel module.

BACKGROUND

Paper towel dispensers are either dispensers that dispense individual paper towels from a roll, and dispensers that dispense paper towels from a folded stack of paper towels. The latter type of dispensers typically include a cabinet that is mounted on a wall at a height that allows dispensing of paper towels to a person standing next to the cabinet. A stack of paper towels is placed in the cabinet such that the stack is oriented vertically inside the cabinet. An opening at the bottom of the cabinet provides access to a paper towel at the bottom of the stack. Paper towels can be manually pulled out of the stack through the opening. The paper towels are folded on top of the each other to form the stack. The fold pattern can be a single-fold, C-fold or multi-fold. The opening is typically an oblong slot having a large center area in order to accommodate various fold configurations and sizes of paper towels.

The above-described paper towel dispensers have several problems associated with the dispensing of paper towels through the opening. When the height of the stack of paper towels is large, the weight of the stack may cause a bloating of the paper towels at the opening such that a cluster of paper towels are exposed. The bloating may also be caused when the bottom opening does not correspond with the size of paper towels being dispensed from the cabinet. The bloating may allow a user to pull out several paper towels at a time and waste paper towels. The bloating may also cause tearing of paper towels when a user is attempting to pull single paper towels from the stack. In addition to the noted functional disadvantages, bloating of paper towels at the opening is not aesthetically pleasing. When the stack of paper towels is low or almost depleted, the remaining paper towels in the stack may fall out of the opening. When the stack of paper towels is high, the paper towels can tear when being pulled out of the opening because of the friction between the paper towel being pulled out and the bottom of the cabinet at the opening. The tearing of the paper towels is particularly problematic when recycled paper towels are used or when a user's hands are wet.

The above-described paper towel dispensers also have a problem associated with the replacement and/or refilling of the paper towel stack. In order to refill the cabinet with paper towels, the face of the cabinet is hinged on one side in order to function as a door. The door can be swung open, thereby allowing a maintenance person to place one or more stacks of paper towels in the cabinet. The paper towel stack typically rests against the back wall of the cabinet. However, depending on the height of the stack, a possibly slight stagger in the paper towels in the stack, and/or the curvature of the paper towel tray, the paper towels may rest against the door of the cabinet. Accordingly, the paper towels can fall out of the cabinet when a maintenance person opens the door to replace the stack or refill the cabinet with one or more stacks of paper towels.

In view of the above, there is a need for a paper towel cabinet or a module for existing paper towel cabinets that can remedy one or more of the above described problems associated with current paper towel dispensers.

SUMMARY

In accordance with one aspect of the disclosure, a paper towel cabinet includes a first side wall and a second side wall, a pivotally mounted front wall defining a door, a back wall extending between the side walls, and a paper towel tray having an opening to provide access to paper towels. The cabinet also includes a module assembly including a first module having a front surface extending transversely relative to the first side wall toward the second side wall. When the door is in an open position, the front surface prevents paper towels leaning toward the door from falling out of the cabinet.

In accordance with another aspect of the disclosure, a paper towel cabinet includes a first side wall and a second side wall, a pivotally mounted front wall defining a door, a back wall extending between the side walls, and a paper towel tray having an opening to provide access to paper towels. The cabinet further includes a module assembly including a first module having a first side surface extending relative to the back wall toward the door, a second side surface generally parallel to the first side surface, a back surface extending between the first side surface and the second side surface, and a front surface extending transversely from the first side surface toward the second side surface. When the door is in an open position, the front surface prevents paper towels leaning toward the door from falling out of the cabinet.

In accordance with another aspect of the disclosure, a paper towel cabinet includes a first side wall and a second side wall, a pivotally mounted front wall defining a door, a back wall extending between the side walls, a paper towel tray having an opening to provide access to paper towels, a front surface extending transversely relative to the first side wall toward the second side wall, and a bar mounted proximate to the opening and having a length extending transversely relative to the side walls. The bar is disposed between the stack of paper towels and the opening when the stack of paper towels is placed on the paper towel tray. When the door is in an open position, the front surface prevents paper towels leaning toward the door from falling out of the cabinet.

Features and advantages of the present disclosure will become apparent from the following description of the preferred embodiments, taken in conjunction with the accompanying drawings, which illustrate, by way of example, the principles of the disclosure.

DETAILED DESCRIPTION

Figure 1:
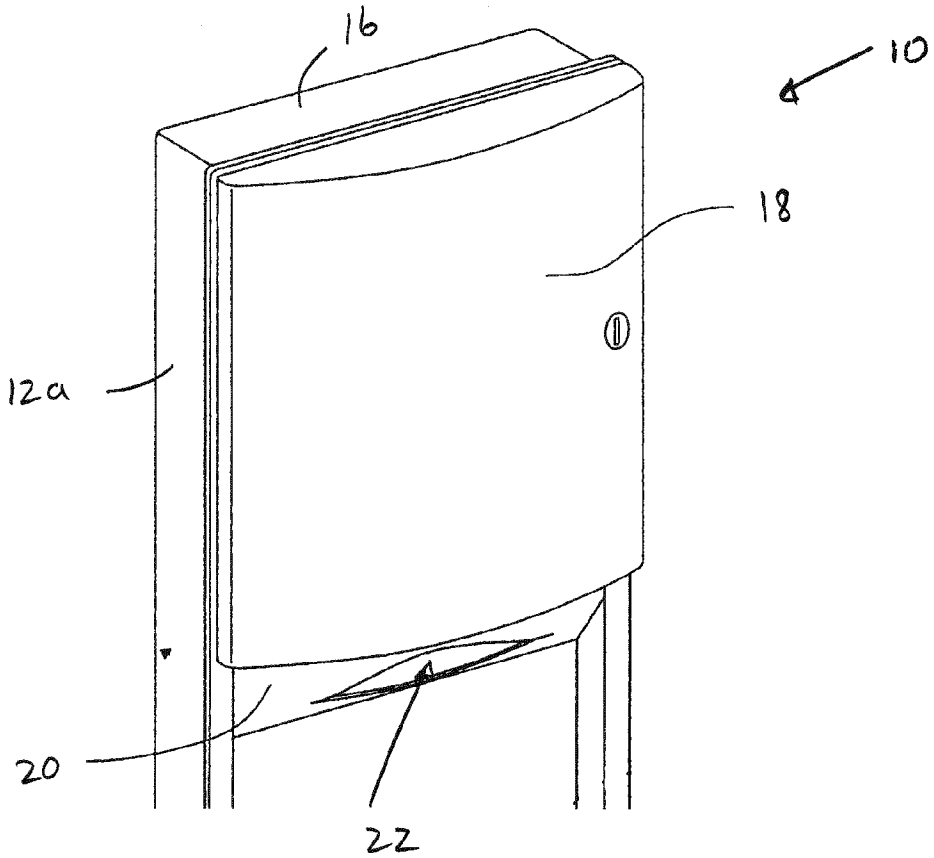
FIG. 1 illustrates a side perspective view of a paper towel cabinet.

Referring to FIG. 1, a paper towel cabinet 10 is shown having a pair of side walls 12*a* and 12*b*, a back wall 14, a top wall 16, and a front wall connected to one of the side walls 12*a* and 12*b* with one or more hinges in order to function as a door 18. The cabinet 10 further includes a paper towel tray 20 for supporting a stack of paper towels. The paper towel tray 20 has an opening 22 for dispensing paper towels. The side walls 12*a* and 12*b*, the back wall 14, the top wall 16, the door 18 and the paper towel tray 20 define the interior of the cabinet 10 in which a stack of paper towels can be housed and accessed from outside the cabinet 10 through the opening 22. The paper towel cabinet 10 may include an adapter 24 (shown in FIG. 2) mounted therein for accommodating a stack of paper towels having a width that is smaller than the internal width of the cabinet 10. The adapter 24 includes a pair of side walls 24*a* and 24*b* connected with a back wall 24*c*. The adapter 24 can be mounted in the cabinet 10 by the back wall 24*c* being mounted to the back wall 14 of the cabinet.

Figure 2:
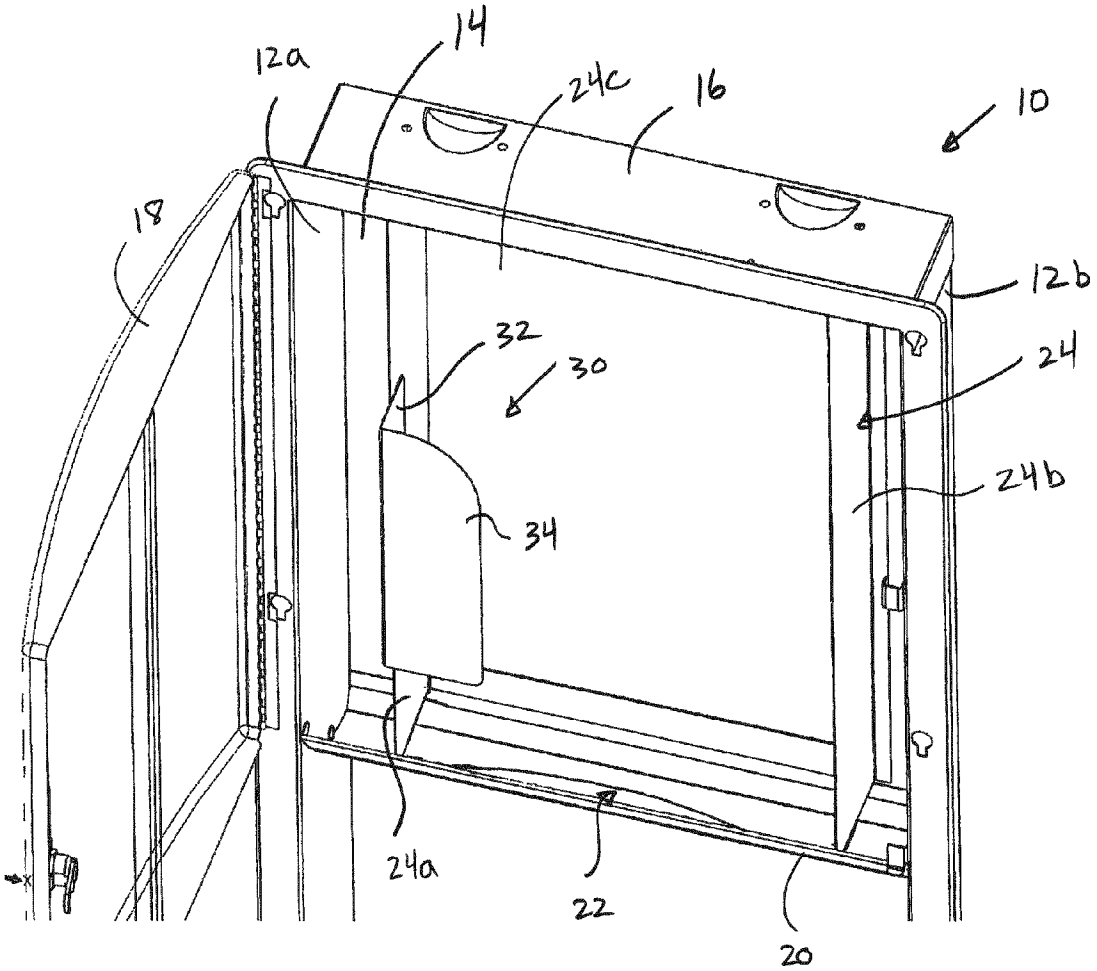
FIG. 2 is a perspective view of the cabinet of FIG. 1 and a module according to a first embodiment of the disclosure.

Referring to FIG. 2, a module 30 according to the first embodiment of the disclosure is shown. The module 30 is in the form of an angle or a generally L-shaped bracket that can be attached to one of the side walls 12*a* and 12*b* and/or the back wall 14 of the cabinet or to one of the side walls 24*a* and 24*b* of the adapter 24. In the example shown in FIG. 2, the module 30 is attached to the side wall 24*a* of the adapter 24. When an adapter 24 is not used in the cabinet 10, the module 30 can be attached to one of the side walls 12*a* or 12*b* and/or the back wall 14. The module 30 can be attached to the cabinet 10 or adapter 24 by welding, with an adhesive, with fasteners, or by other known methods and devices that can provide a secure attachment of the module 30 to the cabinet. In the example shown in FIG. 2, the module 30 includes a first side surface 32 extending generally parallel with the side wall 24*a* and a front surface 34 extending generally transverse to the first side surface 32 and toward the side wall 24*b*. The module 30 can be constructed in one piece with the adapter 24. Accordingly, the module 30 may only include a front surface 34 that is in one piece with the side wall 24*a* and extends transverse to the side wall 24*a*. When a stack of paper towels is placed in the cabinet 10, the paper towels are bound in a generally rectangular region defined by the module 30, the back wall 24*a*, the paper towel tray 20 and the side wall 24*b*. The stack of paper towels can be placed in the cabinet 10 by first inserting one side of the stack at an angle relative to the front surface 34 inside the area defined by the module 30 and the back wall 24. The opposite side of the stack is then moved toward the back wall 24*c* or 14 to fully place the stack of paper towels in the cabinet 10. The weight of the stack of paper towels is supported by the paper towel tray 20. The stack of paper towels can lean on the front surface 34 to prevent the stack from falling out of the cabinet 10 when the door 18 is opened.

The front surface 34 can be configured to extend from the top wall 16 to the paper towel tray 20. Alternatively, as shown in FIG. 2, the height of the front surface 30 may be such that only a portion of the stack of paper towels can lean on the front surface 34. In the latter configuration, the module 30 can be positioned in the cabinet 10 so that the front surface 34 provides direct leaning support for a portion of the stack of paper towels. However, this partial leaning support may be sufficient to prevent the entire stack of paper towels from falling out of the cabinet 10 when the door 18 is opened. In the example shown in FIG. 2, the front surface 34 is closer to the paper towel tray 20 than to the top wall 16. When a stack of paper towels extends above the front surface 34, a portion of the stack that is above the front surface 34 most likely remains positioned with the rest of the stack and will not independently lean on the door 18 due to friction between the paper towels and the relative height of the portion extending above the front surface 34 as compared to the height of the entire stack. When the stack is depleted to a level such that the stack is below the front surface 34, the likelihood of the stack leaning against the door 18 may be very slim to none because the center of gravity of the stack is very near the paper towel tray 20. Accordingly, a module 30 having a front surface 34 that is shorter than the height of the cabinet and positioned so as to support only a portion of the paper towel stack can provide the function of preventing the entire stack of paper towels from falling out of the cabinet when the door 18 is opened.

Figure 3:
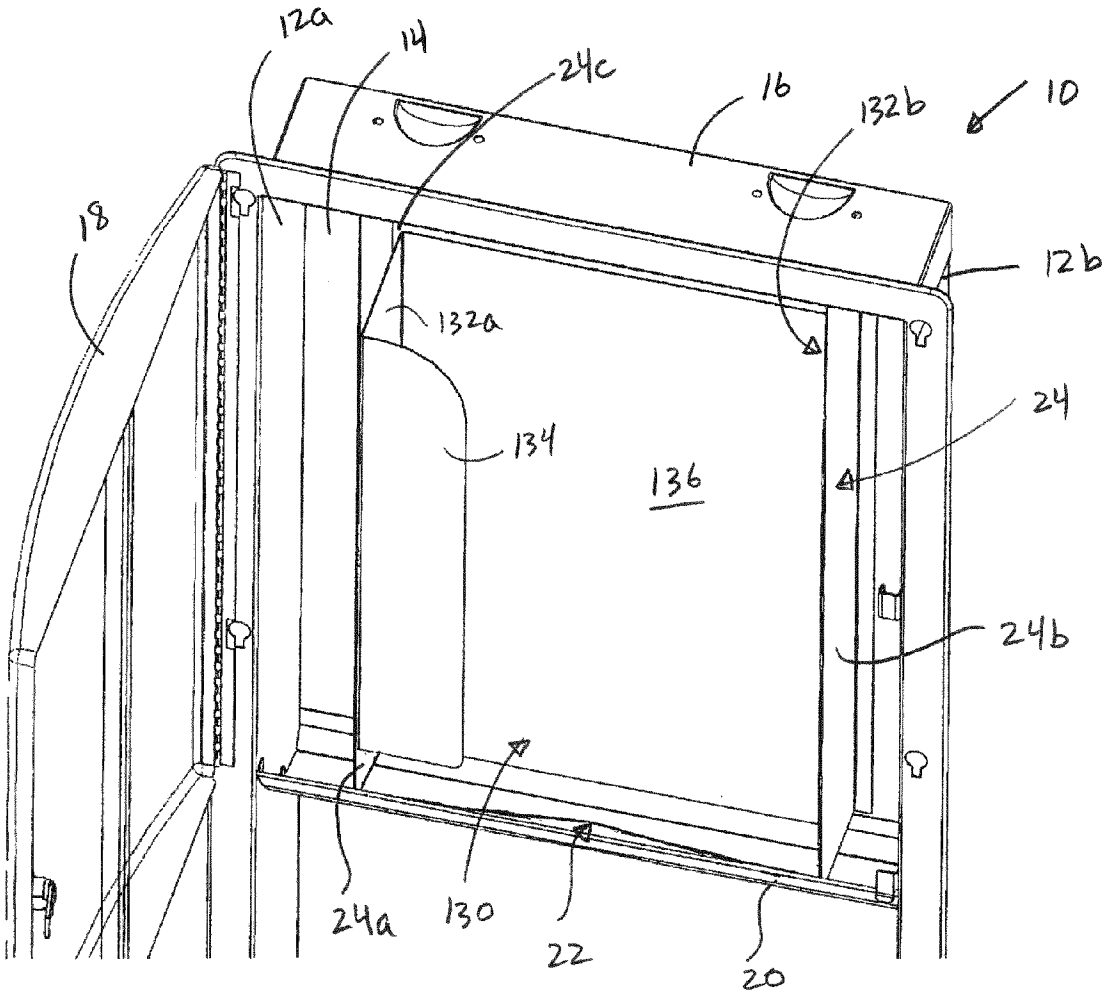
FIG. 3 is a perspective view of the cabinet of FIG. 1 and a module according to a second embodiment of the disclosure.

Referring to FIG. 3, a module 130 according to the second embodiment of the disclosure is shown. The module 130 includes a pair of side surfaces 132*a* and 132*b*, a front surface 134 that is connected to the side surface 132*a* and extends toward the side surface 132*b*, and a back surface 136. The front surface 134 and the side surface 132*a* form a generally L-shaped area for receiving a stack of paper towels. The back surface 136 and/or any of the side surfaces 132*a* and 132*b* can be attached to the cabinet 10 or the adapter 24 by welding, with an adhesive, with fasteners, or by other known methods and device that can provide a secure attachment of the module 130 to the cabinet 10. The entire module 130 may be supported on the paper towel tray 20 without being attached to any part of the cabinet 10.

When a stack of paper towels is placed in the cabinet 10, at least a portion of the stack of paper towels is bound by the module 130. The stack of paper towels can be placed in the module 130 by inserting one side of the stack in the region defined by the front surface 134, the side surface 132*a* and the back surface 136. The opposite side of the stack is then placed in the module 130. The stack of paper towels can lean on the front surface 134 to prevent the stack from falling out of the cabinet 10 when the door 18 is opened.

The front surface 134 may extend from the paper towel tray 20 to the top wall 16 to provide leaning support for the entire stack of paper towels. Alternatively, the front surface 134 may only extend partially between the paper towel tray 20 and the top wall 16 in order to provide leaning support to only a portion of the stack of paper towels placed in the cabinet. However, as described above with respect to the module 30 of the first embodiment, providing direct leaning support to a portion of the stack of paper towels may be sufficient to provide leaning support to the entire stack of paper towels.

Figure 4:
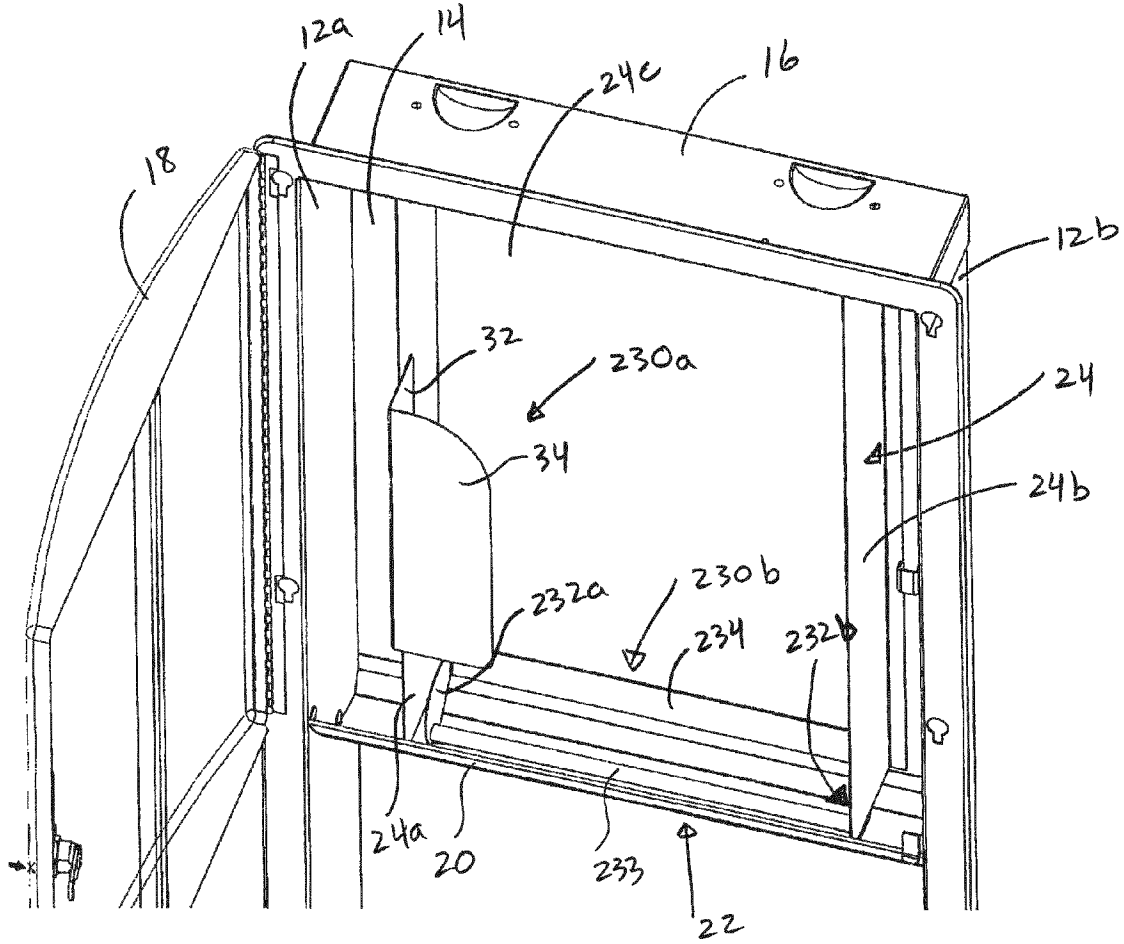
FIG. 4 is a perspective view of the cabinet of FIG. 1 and a module according to a third embodiment of the disclosure.
Figure 5C:
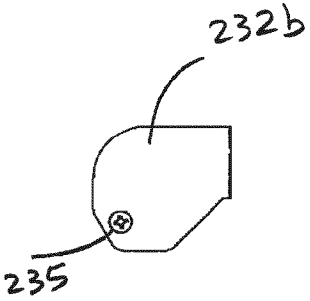
FIGS. 5A-5C are top, front and side elevational views of a module according to the third embodiment of the disclosure.
Figure 5A:
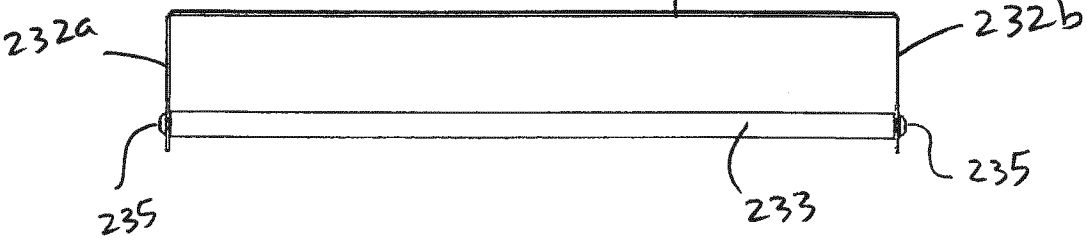
Figure 5B:
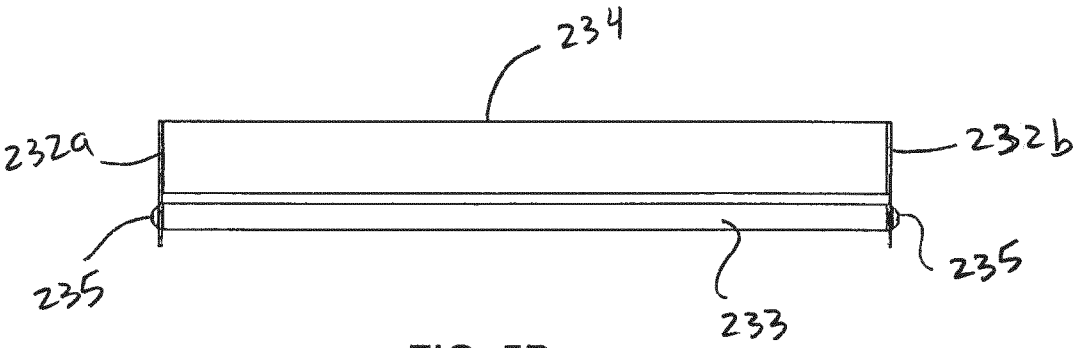

Referring to FIG. 4, a third embodiment of the disclosure is shown to have a first module 230*a*, which is similar to the module 30 of the first embodiment, and a second module 230*b*. Accordingly, parts of the first module 230*a* are referred to with the same reference numbers as the same parts of module 30. Referring also to FIGS. 5A-5C, the second module 230*b* includes a pair of side surfaces 232*a* and 232*b* and a bar 233 that is fixedly or rotationally mounted to the side surfaces 232*a* and 232*b* and extends therebetween. The bar 233 may be mounted to the side surfaces 232*a* and 232*b* with fasteners 235 so as to enable a maintenance person to remove the bar 233 for repair or replacement with another bar. Each of the side surfaces 232*a* and 232*b* can be connected to a corresponding side wall 24*a* and 24*b* of the adapter 24 or to the corresponding side wall 12*a* and 12*b* of the cabinet 10. Alternatively, the second module 230*b* may also include a back surface 234 that connects the side surfaces 232*a* and 232*b* and can be attached to the back wall 24*c* of the adapter 24 or the back wall 14 of the cabinet 10. The module 230*b* is mounted inside the cabinet 10 near the opening 22 such that the bar 233 is positioned above the opening 22. The distance between the bar 233 and the opening 22 may be determined based on a variety of factors, such as the weight, size, thickness, and texture of each paper towel. The module 230*b* can be mounted in the cabinet without the module 230*a*.

Figure 6:
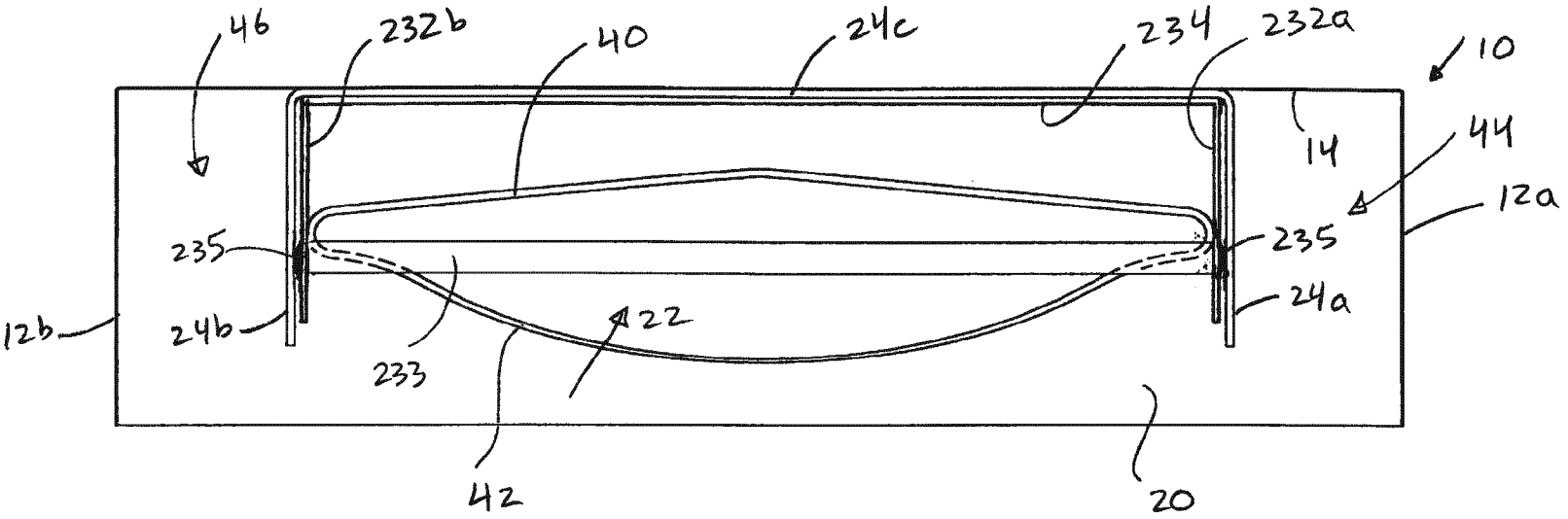
FIG. 6 is a view of a paper towel tray of the cabinet of FIG. 1 with the module of FIGS. 5A-5C.

Referring to FIG. 6, the paper towel tray 20 of the cabinet 10 is shown with the module 230*b*. The opening 22 is defined by a first edge 40 and a second edge 42 that are spaced apart from a first side 44 of the paper towel tray 20 to a second side 46 of the paper towel tray 20. The bar 233 is positioned so as to extend along the opening 20 from the first side 44 to the second side 46 and between the first edge 40 and a the second edge 42. In the example shown in FIG. 6, the bar 233 is shown to be approximately half way between the first edge 40 and the second edge 42. Preferably, the opening 20 is divided by the bar 233 into two substantially similar sized smaller openings from which each paper towel can be pulled out the stack of paper towels housed in the cabinet 10. If the bar 233 is placed too close to the first edge 40, the portion of the opening 22 that will be between the bar 233 and the first edge 40 may be too small for pulling out a paper towel. The small opening may cause tearing in the paper towels and prevent the edge of the next paper towel in the stack to be pulled out from the opening 22. Furthermore, the portion of the opening 22 between the bar 233 and second edge 42 may be too large such that a user can intentionally or unintentionally pull a large number of paper towels from the opening 22. Similarly, if the bar 233 were placed too close to the second edge 42, the portion of the opening 22 between the bar 233 and the second edge 42 may be too small for pulling paper towels out of the opening 22. Additionally, the portion of the opening 22 between the bar 233 and the first edge 42 may be too large so that a user can intentionally or unintentionally pull a large number of paper towels from the opening 22.

When the stack of paper towels is placed in the cabinet 10, the stack may at least partially rest on the bar 233. Accordingly, the weight of the stack may be at least partially supported by the bar 233. The weight of the stack of paper towels may also be partially supported by the paper towel tray 20. The bar 233 may be generally circular or have a curved cross-section so as to provide a curved contact surface between itself and each paper towel at the bottom of the stack of paper towels. The curved surface of the bar 233 can reduce the resistance encountered by a user when pulling a paper towel out of the stack of paper towels. The bar 233 may be fixed to the side surfaces 232*a* and 232*b* such that it cannot rotate when each paper towel is being pulled out of the opening 22. Accordingly, each paper towel slides over the bar 233 while being pulled out of the stack of paper towels. However, the bar 233 may be rotational relative to the side surfaces 232*a* and 232*b* so that it freely rotates when each paper towel is being pulled out of the opening 22.

As described above, the weight of the stack of paper towels may be partially supported by the bar 233. The weight of the stack of paper towels, however, depends on the number of paper towels that are in the stack. As the stack of paper towels is depleted, the weight of the stack is reduced. Accordingly, the frictional force between the paper towel at the bottom of the stack and the bar 233 is reduced and may cause more than one paper towel to fall out or be pulled out of the opening 22. Additionally, when the stack is nearly depleted, the stack becomes light relative to the force by which a user pulls out a paper towel from the bottom of the stack. Accordingly, pulling a single paper towel may lift, flip, and/or move the stack so as to disorient the stack relative to the opening 22. The disorientation of the stack may cause the entire stack to fall out of the opening 22, or position the stack such that the remaining paper towels of the stack can be pulled out together. To prevent the stack from being disoriented in the cabinet 10 when nearly depleted, a weight (not shown) that can be placed on top of the stack of paper towels. Accordingly, as the stack of paper towels is depleted, the change in the total weight of the stack of paper towels and the weight may not be significant. Thus, even when the stack of paper towels is nearly depleted, the action of pulling a paper towel from the stack may not disorient the stack inside the cabinet 10. Instead of using a weight, known biasing mechanisms such as a spring-loaded plate can be used to press down on the stack of paper towels.

Figure 7:
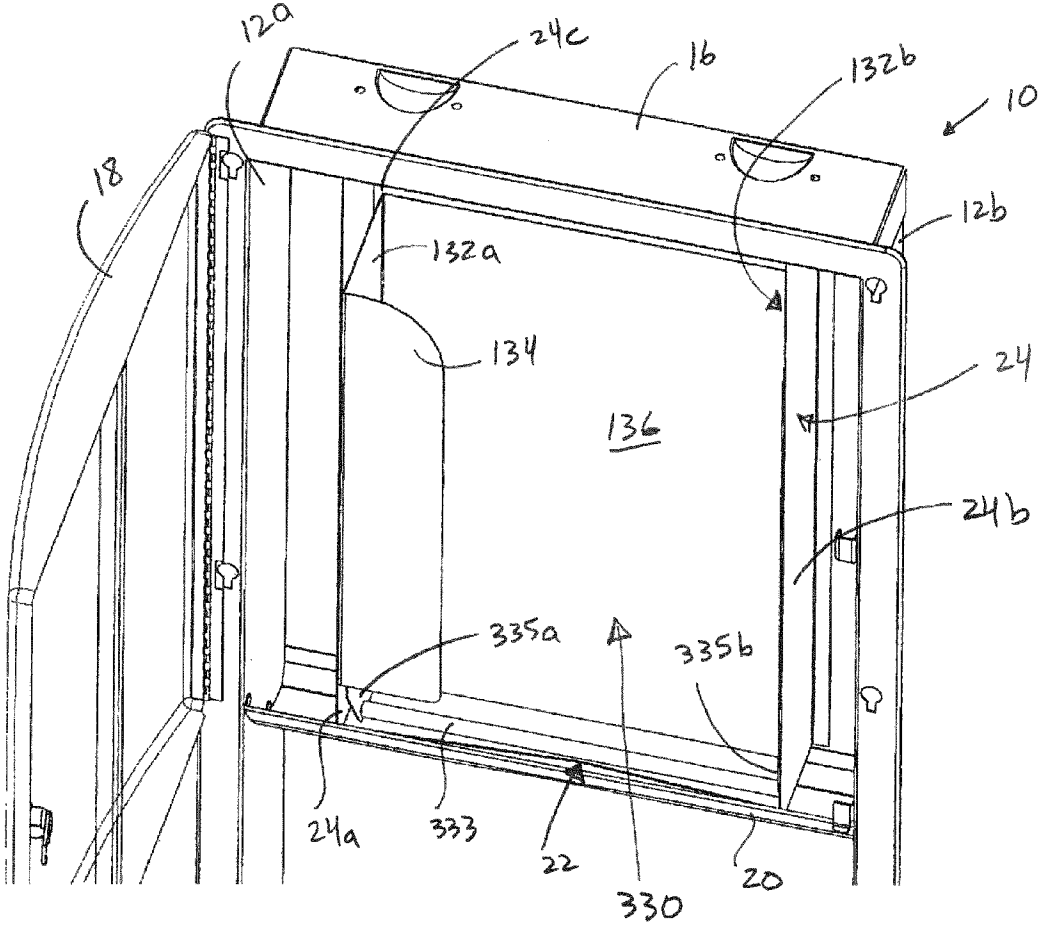
FIG. 7 is a perspective view of the cabinet of FIG. 1 and a module according to a fourth embodiment of the disclosure.

Referring to FIG. 7, a module 330 according to the fourth embodiment of the disclosure is shown. The module 330 is similar to the module 130 except that it includes a bar 333 extending between the side surfaces 132*a* and 132*b*. Accordingly, parts of the module 330 are referred to with the same reference numbers as the same parts of module 130. The bar 333 may be directly connected to the side surfaces 132*a* and 132*b*. Alternatively, as shown in FIG. 7, the module 330 includes support surfaces 335*a* and 335*b* extending below side surfaces 132*a* and 132*b*, respectively. The bar 333 is rotationally or fixedly attached to the brackets 335*a* and 335*b* with fasteners so as to enable a maintenance person to remove the bar 333 for repair or replacement with another bar. The function of the bar 333 is similar to the function of the bar 233 of the third embodiment discussed above.

Figures 8A, 8B, 8C:
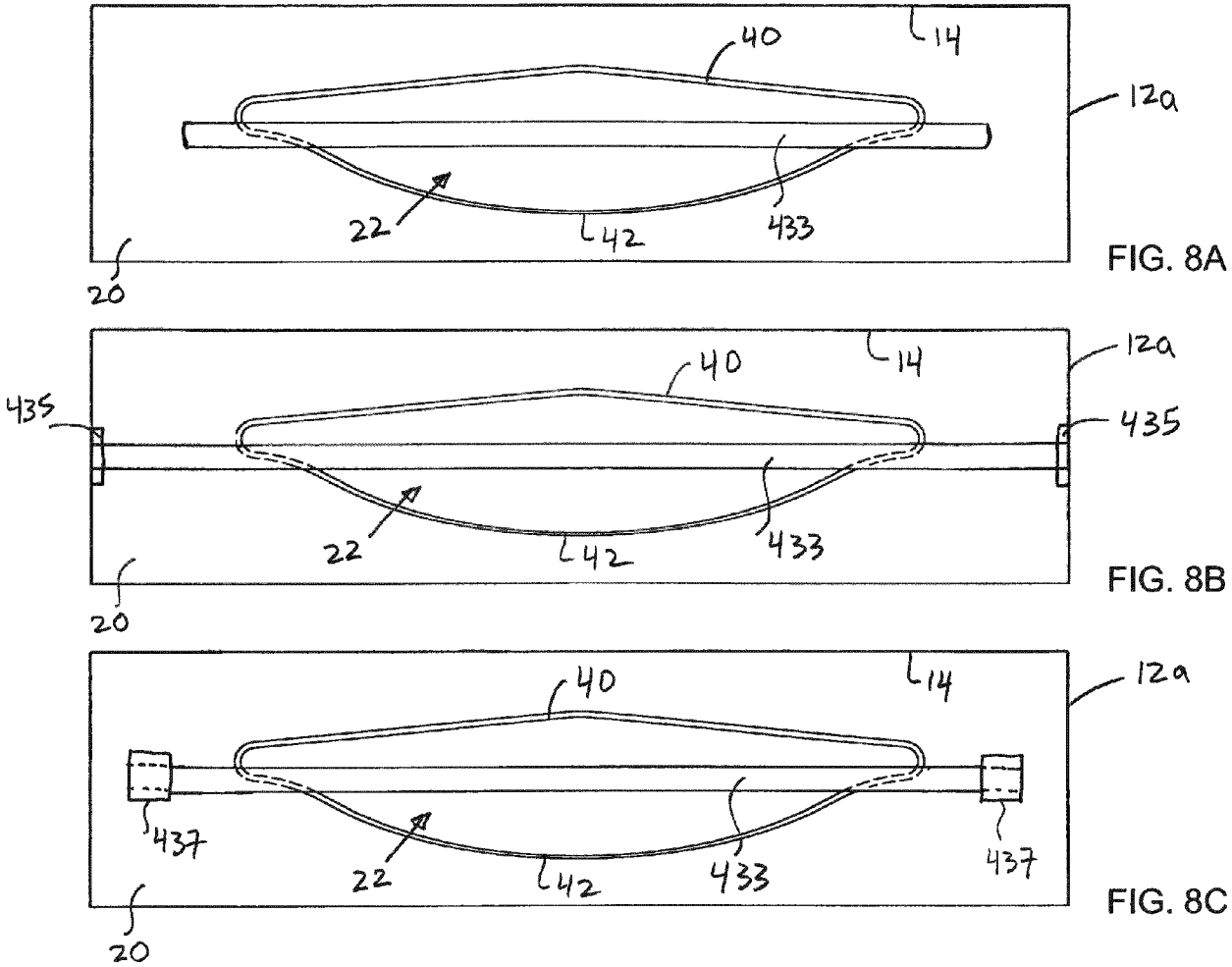
FIGS. 8A-8C are views of a paper towel tray of the cabinet of FIG. 1 with a module according to the fifth embodiment of the disclosure.

Referring to FIGS. 8A-8C, a module 430 according to a fifth embodiment of the disclosure is shown. The module 430 includes a bar 433 for mounting near the opening 22 of the paper towel tray 20 as described above. Referring to FIG. 8A, the bar 433 may be positioned at the opening 22. The bar 433 may rest on the paper towel tray 20. Alternatively, the bar may be maintained by a groove or an indentation (not shown) in the paper towel tray 20 that is configured to receive all or a portion of the bar 433. Referring to FIG. 8B, the bar can be fixedly or rotationally mounted to the side walls 12*a* and 12*b* of the cabinet by using brackets or known mounting hardware such as a variety of fasteners. The noted mounting hardware is generally shown in FIG. 8B with reference number 435. For configurations where the bar is fixedly mounted to the cabinet and is not to be removed, the bar 433 can be welded or mounted with adhesives to the side walls 12*a* and 12*b* of the cabinet (not shown). Referring to FIG. 8C, the bar 433 can be rotationally or fixedly mounted to the paper towel tray 20 by using brackets or known mounting hardware such as a variety of fasteners, which are generally shown in FIG. 8C with reference number 437. Although not shown, the bar 433 can also be welded to the paper towel tray 20 or fixedly attached thereto with an adhesive. Similarly, the bar 433 can be mounted to the back wall 14 by the devices and methods described above.

Although the above embodiments are described separately, they can be used in combination if desired. For example, the module 130 of the second embodiment and the module 230*b* of the third embodiment can be mounted together in a paper towel cabinet. In another example, the module 30 of the first embodiment can be provided with a lower support surface similar to the support surfaces 335*a* and 335*b* of the module 330 for supporting a bar that extends along the opening as described above. In yet another example, the module 430 of the fifth embodiment, which includes a bar 433 and may include mounting hardware 435 or 437, can be mounted inside the cabinet either alone or with one of the modules 30, 130 or 230*a*.

The cabinet 10 is described has optionally having the adapter 24 to accommodate paper towels that have a smaller width than the width of the cabinet. However, the cabinet 10 may not require the adapter 24 in cases where the paper towels are size to properly fit in the cabinet 10. Accordingly one of ordinary skill in the art will recognize that the components of the disclosed modules that couple, connect or engage with the certain parts of the cabinet can similarly couple, connect or engage to similar parts of the adapter.

The orientation of the various surfaces of the above-described modules may vary depending on the type of cabinet or application of the module. For example, the front surface of each module may be oriented at a right angle relative to the side surface to which it is connected. Alternatively the front surface may be oriented at a different angle relative to the side surface depending on the size, shape and internal angles of various parts of the cabinet. Furthermore, although the terms "surface" and "walls" are used herein to describe the components of the cabinet and the modules, any of the surfaces and walls may be formed by a flat or curved surface and may be constructed from a mesh, a plurality of rods or elongated elements forming a lattice, woven strings, wires, or any other geometrical and material configuration that can provide the functionality of the surfaces and walls described herein. For example, the front surface of each of the above described modules can be formed by a wire mesh. In another example, the front surface of each of the above described modules can be formed by one or more vertically, horizontally or diagonally oriented rods that provide leaning support to a stack of paper towels.

The modules described above which include a front surface for providing leaning support to an end portion of a stack of paper towels may include a second front surface located laterally opposite to the first front surface to also provide leaning support to the opposite end portion of the stack of paper towels. However, having a second front surface may make the loading of paper towels difficult as the paper towels would have to be inserted in the module from a narrow opening in front of the module. Accordingly, the second front surface may be narrower than the first surface or not provided at all.

The above-described modules can be mounted inside existing paper towel cabinets in order to prevent the stack of paper towels from falling out of the cabinet when the front door of the cabinet is opened. Furthermore, new paper towel cabinets can be constructed with the disclosed modules separately incorporated therein or constructed integrally therewith.

While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. A paper towel cabinet comprising:

a first side wall and a second side wall;

door extending at least between the first and second side walls and moveable between an open and a closed position;

a back wall extending between the side walls;

a paper towel tray having an elongated opening to provide access to paper towels; and a module assembly comprising a first module for retaining paper towels, said first module having a single front surface extending transversely relative to the first side wall toward the second side wall, said single front surface being the sole front surface in said module assembly for retaining all paper towels in a direction toward said front surface, and wherein said module assembly is the only assembly for retaining said paper towels; and a bar extending across the elongated opening in a direction transversely to the first and second side walls, the bar dividing the elongated opening into two dispensing openings, wherein said paper towels are dispensable through both dispensing openings, wherein when the door is in the open position, the front surface prevents paper towels leaning toward the door from falling out of the cabinet.

2. The paper towel cabinet of claim 1, wherein the first module further comprises a first side surface extending transversely relative to the back wall toward the door, and wherein the front surface is connected to the first side surface and extends transversely from the first side surface.

3. The paper towel cabinet of claim 2, wherein the first side surface is attached to at least one of the back wall and the first side wall.

4. The paper towel cabinet of claim 1, wherein the front surface is attached to the first side wall.

5. The paper towel cabinet of claim 1, further comprising a second module mounted in the cabinet below the first module, the second module comprising:

a first side surface;

a second side surface;

wherein the bar is mounted to the first side surface of the second module and the second side surface of the second module and extends therebetween; and wherein the bar is located between a stack of paper towels and the opening.

6. The paper towel cabinet of claim 2, further comprising a back surface connecting the first side surface and the second side surface, wherein the back surface is attached to the back wall.

7. The paper towel cabinet of claim 1, wherein when the door is in the open position and a stack of paper towels is located in a space defined by the side walls, the back wall and the front surface, a first end portion of the stack of paper towels is bound by the front surface, the first side wall and the back wall, and a second end portion of the stack of paper towels opposite to the first end portion is only bound by the second side wall and the back wall.

8. The paper towel cabinet of claim 1, wherein the front surface comprises a curved upper edge.

9. A paper towel cabinet comprising:

a first side wall and a second side wall;

a door extending at least between the first and second side walls and moveable between an open and a closed position;

a back wall extending between the side walls and spaced apart from the door;

a paper towel tray having an elongated opening to provide access to paper towels;

a module assembly comprising a first module comprising:

a first side surface extending transversely relative to the back wall toward the door;

a back surface connected to the first side surface and extending transversely from the first side surface;

a second side surface connected to the back surface and extending transversely from the back surface and generally parallel to the first side surface, wherein the back surface extends from the first side surface to the second side surface; and a front surface extending transversely from the first side surface toward the second side surface and being spaced apart from the back surface, said front surface being closer to said door than said back surface; and a bar extending across the elongated opening in a direction transversely to the first and second side walls, the bar dividing the elongated opening into two dispensing openings, wherein said paper towels are dispensable through both dispensing openings, wherein when the door is in an open position, the front surface is a sole front surface for preventing all of the paper towels leaning toward the door from falling out of the cabinet.

10. The paper towel cabinet of claim 9, wherein the bar is attached to the first side surface and the second side surface and extends therebetween, wherein the bar is configured to be located between a stack of paper towels and the opening.

11. The paper towel cabinet of claim 9, the module assembly further comprising a second module mounted in the cabinet below the first module, the second module comprising:

a first side surface;

a second side surface;

wherein the bar is mounted to the first side surface of the second module and the second side surface of the second module and extends therebetween; and wherein the bar is located between a stack of paper towels and the opening.

12. The paper towel cabinet of claim 11, further comprising a back surface connecting the first side surface and the second side surface, wherein the back surface is attached to the back wall.

13. The paper towel cabinet of claim 9, wherein a space between a free edge of the front surface and the second side surface is unobstructed.

14. The paper towel cabinet of claim 9, wherein when the door is in the open position and a stack of paper towels is located in a space defined by the first side surface, the second side surface, the back surface and the front surface, a first end portion of the stack of paper towels is bound by the front surface, the first side surface and the back surface, and a second end portion of the stack of paper towels opposite to the first end portion is only bound by the second side surface and the back surface.

15. The paper towel cabinet of claim 9, wherein the front surface comprises a curved upper edge curving from the first side surface to a vertical edge surface of the front surface.

* * * * *

UNITED STATES PATENT AND TRADEMARK OFFICE

CERTIFICATE OF CORRECTION

PATENT NO. : 8,978,925 B2
APPLICATION NO. : 12/618653
DATED : March 17, 2015
INVENTOR(S) : Dikran Babikian It is certified that error appears in the above-identified patent and that said Letters Patent is hereby corrected as shown below:

In the Specification

| | |
|---|---|
| Col. 5, line 7 | Delete "and a the", |
| | Insert --and the-- |
| Col. 5, line 12 | Delete "out the stack", |
| | Insert --out of the stack-- |
| Col. 5, line 65 | Delete "(not shown) that", |
| | Insert --(not shown)-- |
| Col. 6, line 61 | Delete "described has optionally", |
| | Insert --described as optionally-- |
| Col. 6, line 65 | Delete "are size", |
| | Insert --are sized-- |

Signed and Sealed this
Twenty-third Day of August, 2016

Michelle K. Lee

Michelle K. Lee
*Director of the United States Patent and Trademark Office*